US005785442A

United States Patent [19]

Hamisch, Jr. et al.

[11] Patent Number: 5,785,442

[45] Date of Patent: Jul. 28, 1998

[54] PRINTER HOUSING STRUCTURE

[75] Inventors: Paul H. Hamisch, Jr., Franklin; John D. Mistyurik, Troy, both of Ohio

[73] Assignee: Monarch Marking Systems, Inc., Dayton, Ohio

[21] Appl. No.: 431,999

[22] Filed: May 1, 1995

Related U.S. Application Data

[62] Division of Ser. No. 137,660, Oct. 15, 1993, abandoned.

[51] Int. Cl.[6] ..... B41J 29/02

[52] U.S. Cl. ..... 400/693; 400/692

[58] Field of Search ..... 400/174, 175, 400/207, 208, 88, 120.16, 120.17, 691, 692, 693, 693.1

[56] References Cited

U.S. PATENT DOCUMENTS

| | | | |
|---|---|---|---|
| D. 327,495 | 6/1992 | Nagai . | |
| 2,764,934 | 10/1956 | Kaplan . | |
| 3,774,538 | 11/1973 | Bullock . | |
| 4,160,605 | 7/1979 | Neubaum . | |
| 4,479,730 | 10/1984 | Yoshioka et al. . | |
| 4,581,616 | 4/1986 | Ross et al. . | |
| 4,609,298 | 9/1986 | Shioda . | |
| 4,611,218 | 9/1986 | Watanabe . | |
| 4,655,623 | 4/1987 | Gasser . | |
| 4,673,304 | 6/1987 | Liu et al. . | |
| 4,678,139 | 7/1987 | Harry | 400/208 |
| 4,685,815 | 8/1987 | Baranyi . | |
| 4,702,631 | 10/1987 | Watanabe . | |
| 4,776,714 | 10/1988 | Sugiura et al. . | |
| 4,830,523 | 5/1989 | Sparer et al. . | |
| 4,832,514 | 5/1989 | Basile . | |
| 4,899,172 | 2/1990 | Berson . | |
| 4,910,602 | 3/1990 | Sakuragi . | |
| 4,914,452 | 4/1990 | Fukawa . | |
| 4,915,516 | 4/1990 | Shimizu et al. . | |
| 4,924,242 | 5/1990 | Fukawa . | |
| 4,944,619 | 7/1990 | Suzuki et al. . | |
| 4,957,379 | 9/1990 | Hamisch, Jr. et al. . | |
| 4,970,531 | 11/1990 | Shimizu et al. . | |
| 5,035,325 | 7/1991 | Kitsuki . | |
| 5,128,763 | 7/1992 | Sakuragi . | |
| 5,262,804 | 11/1993 | Petigrew | 400/88 |
| 5,378,071 | 1/1995 | Uehara | 400/120.16 |
| 5,378,072 | 1/1995 | Gunderson | 400/692 |
| 5,435,657 | 7/1995 | Pearce et al. | 400/242 |
| 5,451,996 | 9/1995 | Awai et al. | 400/207 |

FOREIGN PATENT DOCUMENTS

| | | | |
|---|---|---|---|
| 0034766 | 2/1989 | Japan | 400/692 |
| 0258382 | 10/1990 | Japan | 400/692 |
| 1455915 | 11/1976 | United Kingdom . | |

*Primary Examiner*—Ren Yan

*Attorney, Agent, or Firm*—Joseph J. Grass

[57] ABSTRACT

There is disclosed a portable thermal printer having a printer housing, a printing mechanism and an ink ribbon cartridge containing an ink ribbon cartridge containing an ink ribbon. The cartridge has a cartridge housing and an improved brake for applying a slight braking force on a core of an ink ribbon supply roll in the housing. The cartridge is easy to load onto the printer. The cartridge forms part of the printer housing and is latched thereto. The cartridge is slid onto the printer and the cartridge housing detents into position.

13 Claims, 12 Drawing Sheets

44
44'
165
68
67
57
49
50
72
70
51
44'
72
49
41
82
35
41

91
92
89
94
93
92
90
89
46
84
83b
83c
83a
83'
83
83b
83c
83''
83a
83b
83c
86
89'
87
84
89'
83a
89'
87
88
86

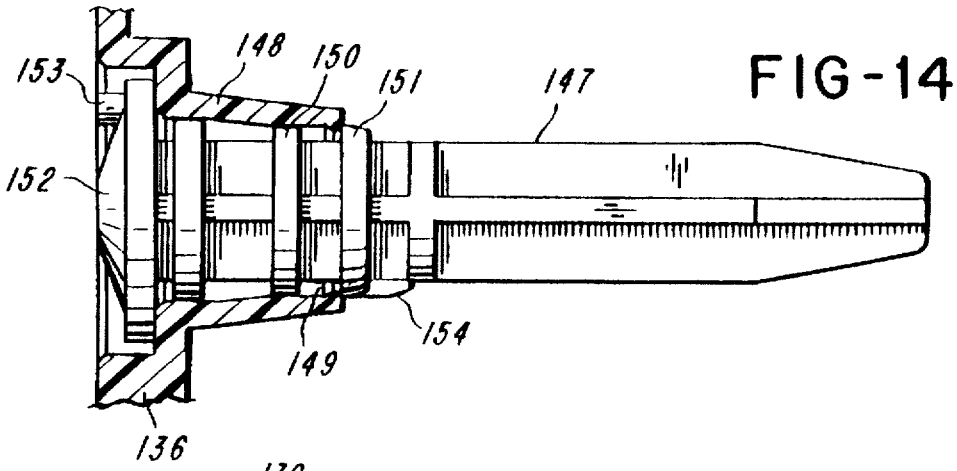
FIG-14
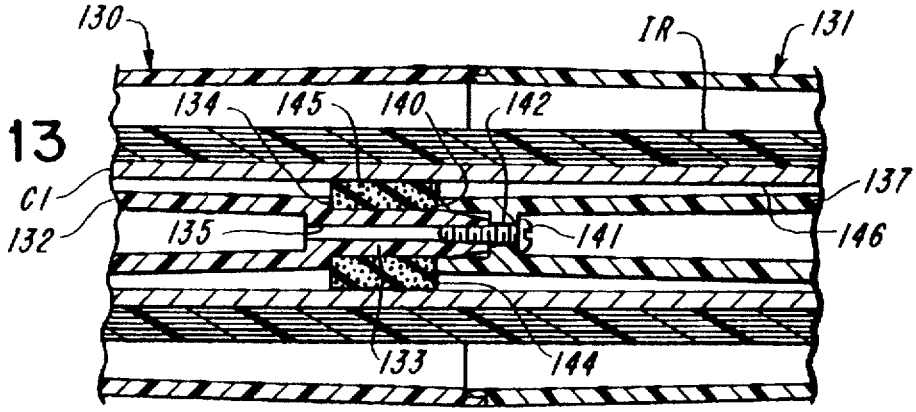
FIG-13
FIG-15
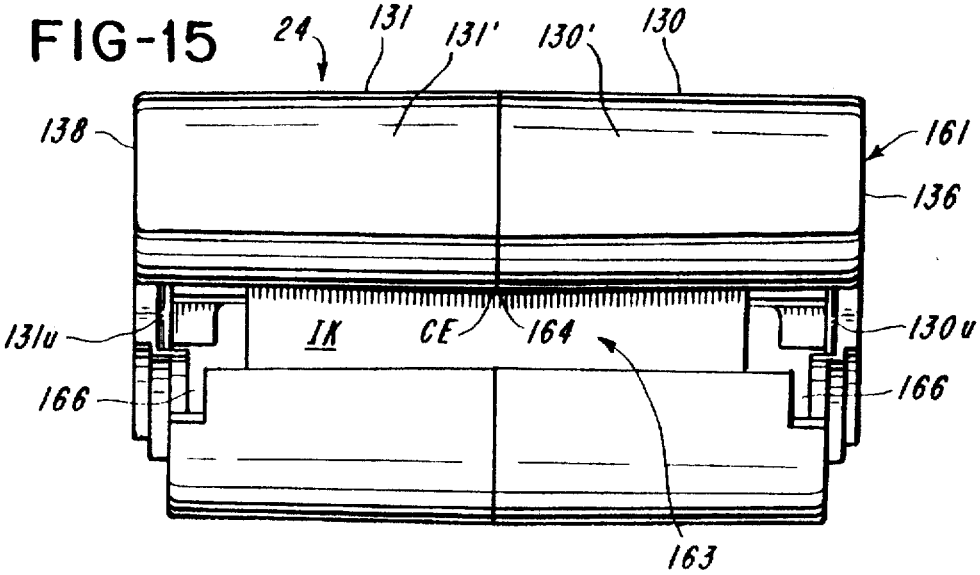

PRINTER HOUSING STRUCTURE

CROSS-REFERENCE TO RELATED APPLICATION

This is a division of application Ser. No. 08/137,660, filed Oct. 15, 1993, now abandoned.

BACKFROUND OF THE INVENTION

1. Field of the Invention

This invention relates to the field of printers and ink ribbon cartridges and methods pertaining thereto.

2. Brief Description of the Prior Art

The following prior art is made of record: U.S. Pat. Nos. Des. 327,495; 2,764,934; 3,774,538; 4,160,605; 4,479,730; 4,581,616; 4,609,298; 4,611,218; 4,655,623; 4,673,304; 4,685,815; 4,702,631; 4,776,714; 4,830,523; 4,832,514; 4,899,172; 4,910,602; 4,914,452; 4,915,516; 4,924,242; 4,944,619; 4,957,379; 4,970,531; 5,035,325; 5,128,763; and British patent 1,455,915.

SUMMARY OF THE INVENTION

The invention relates to an improved, user-friendly, compact, portable, small-footprint, easy-to-use printer.

A feature of the invention is an improved ink ribbon cartridge. A specific embodiment of the cartridge is comprised of a cartridge housing with a stationary shaft and a brake member on the shaft in frictional contact with an inner surface of a core of an ink ribbon roll. The brake member cooperates with the core to prevent an excessive amount of ink ribbon to be paid out during the printing operation and to maintain tension in the ink ribbon.

Another feature of the invention is the new use of a tubular member as a brake member cooperating with the inner surface of a core of an ink ribbon roll.

Another feature of the invention resides in an improved arrangement for coupling an ink ribbon cartridge into a printer. In a specific embodiment, the ink ribbon cartridge includes a housing with first and second housing members spaced apart to provide an opening. The print head has a line of printing elements and is mounted on a support. The cartridge is mounted onto the printer so that the support and the print head enter the opening between the housing members of the cartridge.

It is another feature of the invention for the cartridge to have a flexible resilient housing wall within which the ink ribbon is based. The housing wall deflects resiliently while the cartridge is being inserted until the housing wall encounters a recess which causes the cartridge to detent essentially into its operating position.

It is a feature of the invention to provide an improved arrangement for detenting a cartridge in a printer.

It is a feature of the invention to provide an ink ribbon cartridge that forms part of an improved housing assembly of a printer. In a specific embodiment, a portion of the cartridge is received in the printer housing and another portion extends outside the printer housing. The print head is mounted on a support and the cartridge has an opening for receiving the support. The printer, thus, has a very compact organization.

It is a feature of the invention to provide an improved housing assembly for a printer in which the printer includes a printer housing and an ink ribbon cartridge coupled to the printer housing. In a specific embodiment, the cartridge is located and latched in its operating position, preferably by a toggle mechanism.

It is a another feature of the invention to provide a thermal printer operable in both thermal direct and thermal transfer modes, wherein an ink ribbon cartridge housing is effective for forming a portion of the guideway for the web to be printed upon and for providing part of the printer housing during operation in the thermal direct mode, and wherein the cartridge housing is effective additionally for supplying ink ribbon to the thermal print head during operation in the thermal transfer mode.

Other features of the invention will be evident to one skilled in the art by reference to the drawings, the following description and the appended claims.

BRIEF DESCRIPTION OF THE DRAWINGS

FIG. 13 is a sectional view of the cartridge showing a brake;

FIG. 14 is a view showing a fragmentary portion of the cartridge and a drive spindle; and FIG. 15 is a rear elevational view of the cartridge.

DETAILED DESCRIPTION OF THE PREFERRED EMBODIMENT

Figure 1:
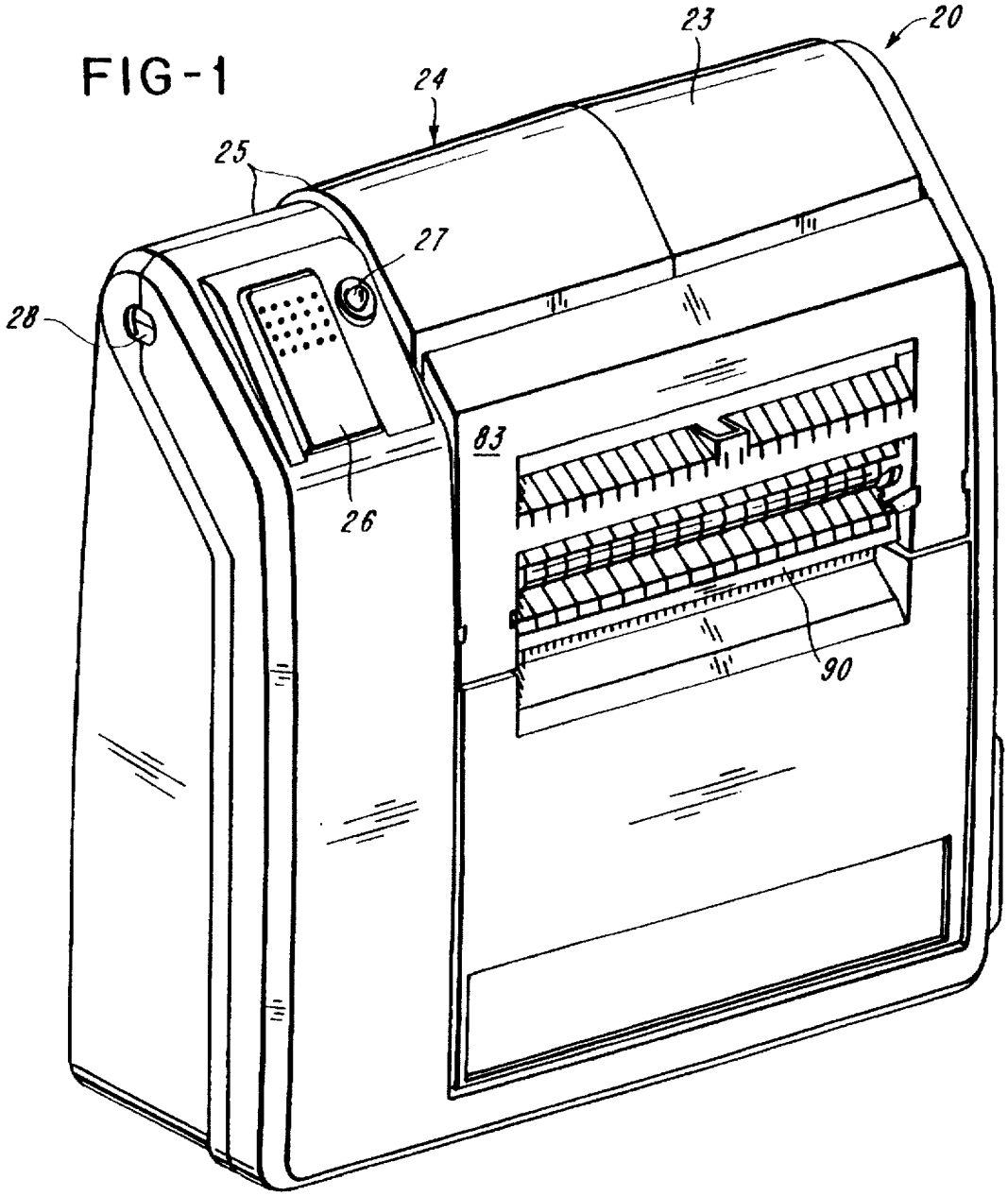
FIG. 1 is a perspective view of the printer of the invention.

With reference to FIG. 1, there is shown a printer generally indicated at 20 which includes a housing generally indicated at 21. The printer 20 has a relatively small footprint so that its base 22 only occupies a small area on a supporting surface. The housing 21 extends generally vertically, as shown with its vertical extent being relatively long. The printer 20 can also be worn by an operator using a suitable carrying strap (not shown). The housing 21 and a housing 23 of an ink ribbon cartridge generally indicated at 24 form a housing assembly 25.

The housing mounts an on/off surface 26, a light 27 for showing whether the printer 20 is "on" or "off", and certain printer error conditions, and aligned recesses 28 (only one of which is shown) at opposite sides of the housing for connecting the ends of the carrying strap to the housing 21.

Figure 2:
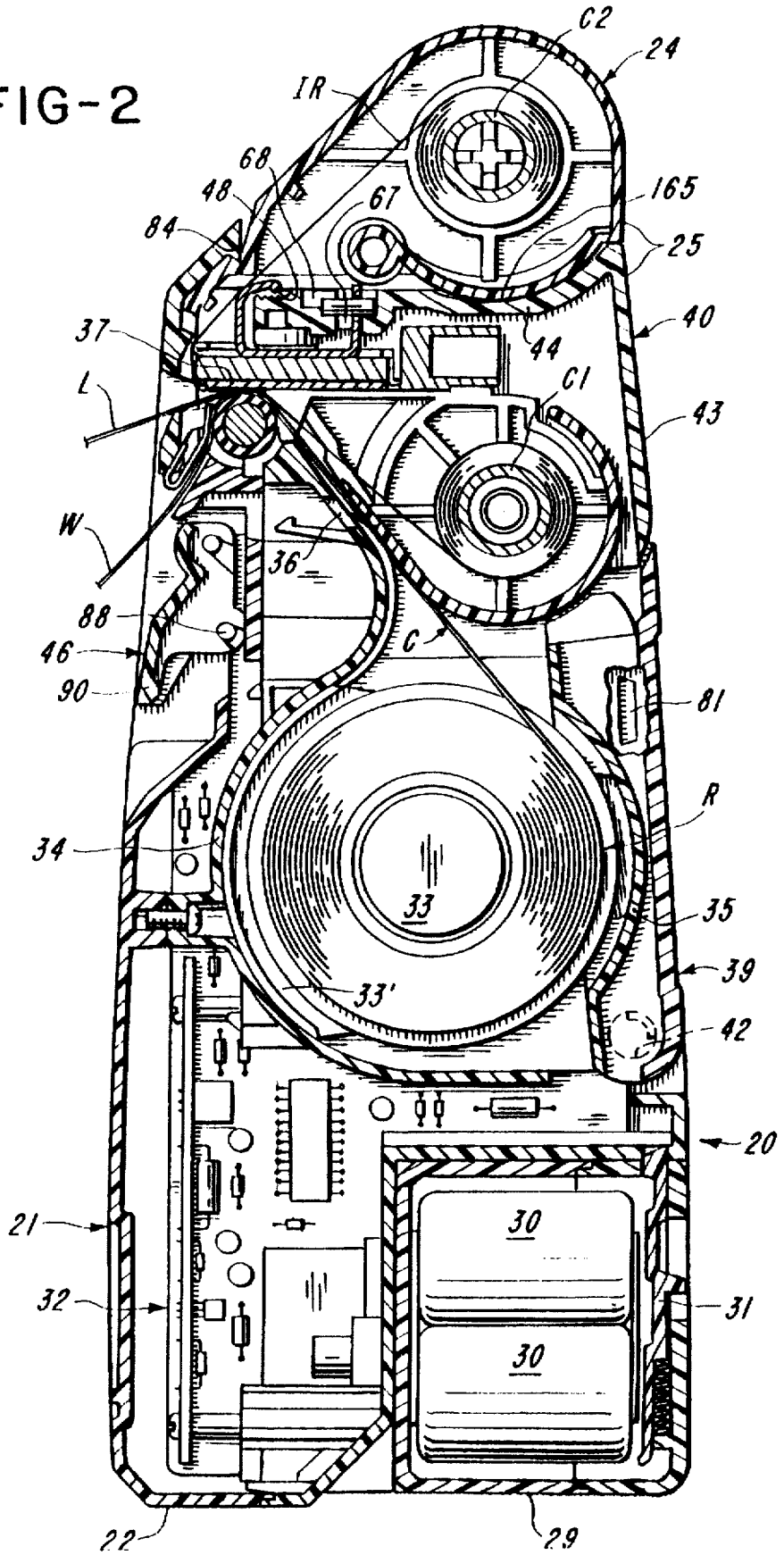
FIG. 2 is a vertical sectional view of the printer.

With reference to FIG. 2, the housing 21 is shown to removably mount a battery pack 29 containing a series of rechargeable batteries 30. A spring-urged latch 31 releasably holds the battery pack 29 in position. The housing 21 also mounts electronic controls generally indicated at 32.

The housing 21 mounts a pair of opposed hub members 33, only one of which is shown, for mounting a roll R of record members. The illustrated roll R is shown to be a composite web C comprised of a carrier web W and labels L releasably adhered to the carrier web W along its length. However, the roll R can alternatively be comprised of a web of tags (not shown). The housing 21 has a chamber 33' which receives the roll R. The chamber 33 is comprised of opposed concave arcuate walls 34 and 35. The wall 34 merges with a guide 36 which helps guide the composite web C (or the tag web as the case may be) from the roll R to between a print head 37 and a platen roll 38. The housing 21 also includes mounting sections 39 and 40. The mounting section 39 is pivotally mounted on posts 41 received in opposed holes 42. The mounting section 39 includes the wall 35. The mounting section 40 is pivotally connected to the mounting section 39. The mounting section 40 has a generally vertically extending outer wall portion 43 and a shelf or generally horizontally extending portion 44. The shelf 44 has a pair of spaced arm or support portions 44' which mount the cartridge 24. The arm portions 44' are received in respective U-shaped channels **130*u* and 131*u* in the cartridge housing 23. The channel 130*u* is comprised of ribs 130*a*, 130*b* and 130*c*, and the channel 131*u* is comprised of ribs 131*a*, 131*b* and 131*c*. The shelf 44 mounts a print head assembly 45. The ink ribbon cartridge 24 is received on the printer 20 as best shown in FIG. 2. An assembly generally indicated at 46 is used to latch the housing 23 of the cartridge 24 and mounting section 40 to the housing 21** and to guide the carrier web W.

Figure 3:
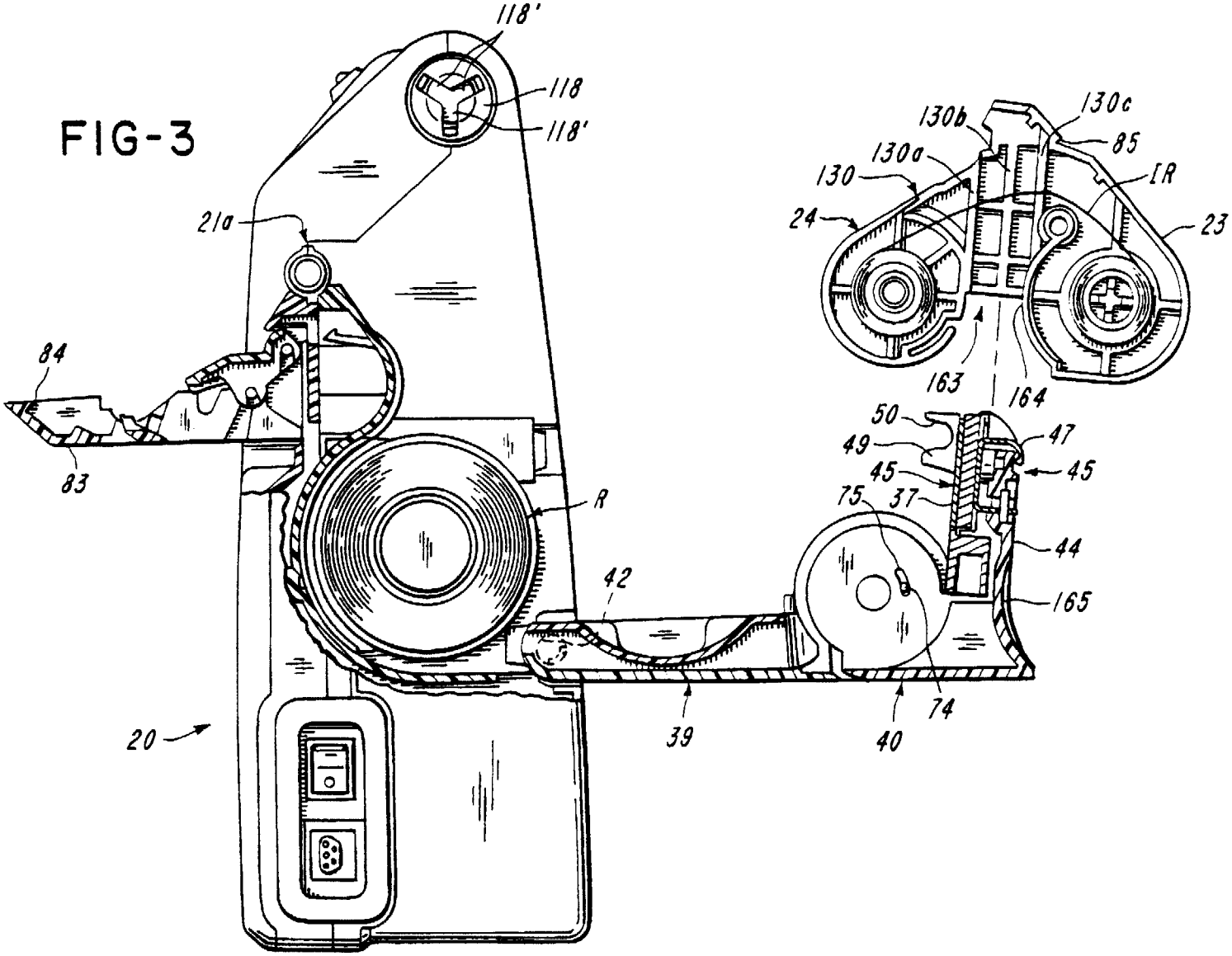
FIG. 3 is a view similar to FIG. 2 but showing the printer in its open position and showing the ink ribbon cartridge exploded away.
Figure 4:
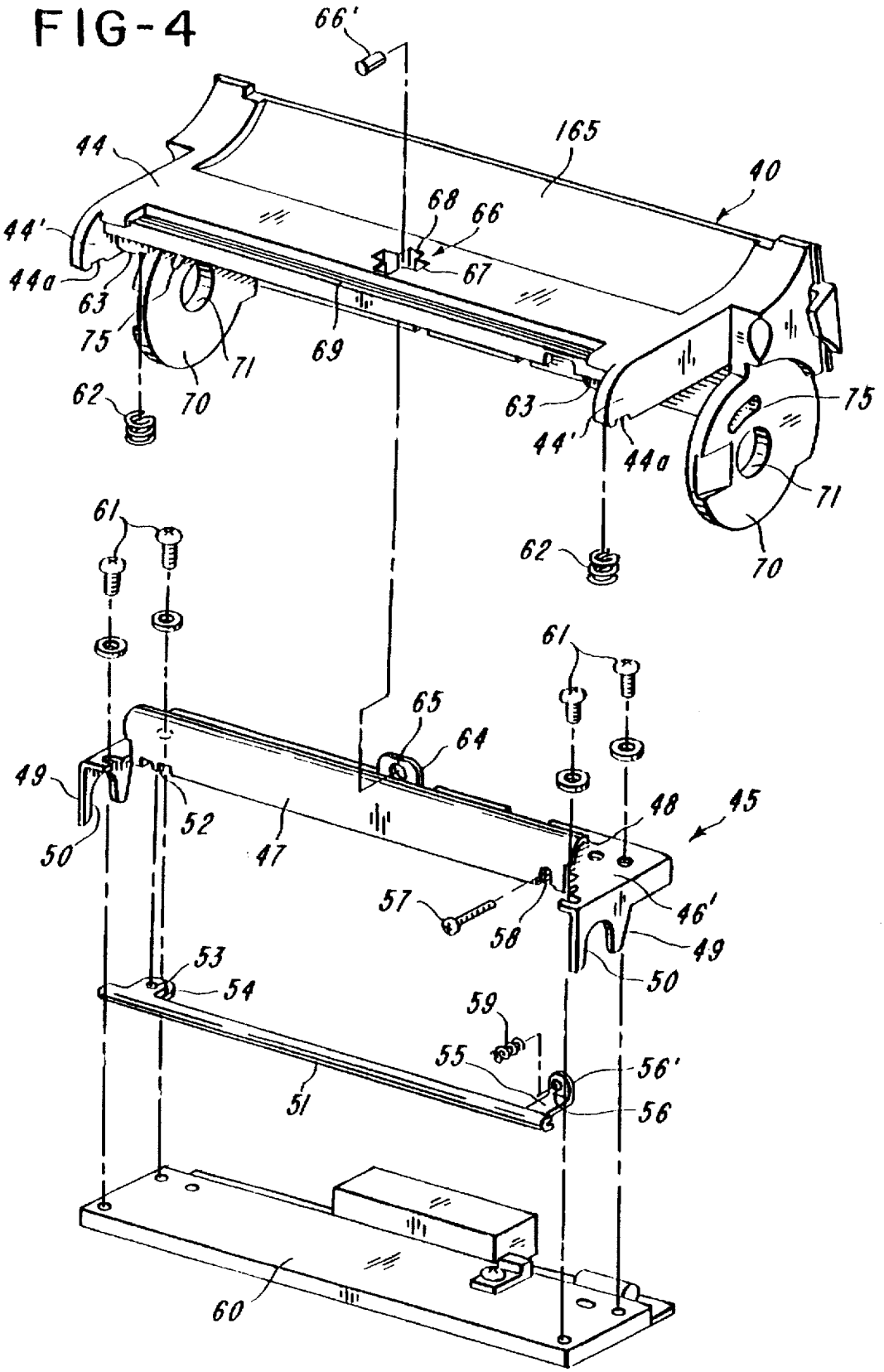
FIG. 4 is an exploded perspective view of a mounting section and a print head assembly mounted by the mounting section.

As shown in FIG. 4, the mounting section 40 mounts the print head assembly 45. The print head assembly 45 includes a plate 46' which extends generally horizontally. The plate 46' has an upturned curved plate portion 47 (FIGS. 2, 3 and 4) which terminates at a downwardly extending knife-shaped edge 48 (FIGS. 3 and 4).

A depending guide 49 having an inverted U-shaped guide surface 50 is connected to each end of the plate 46'. An ink ribbon guide 51 is mounted to the plate portion 47. When correctly adjusted the guide 51 causes the ink ribbon IR to track correctly. The plate portion 47 has a depending stud 52 which is received in a hole 53 in the guide 51. The guide 51 has an integrally formed plate 54. The guide 51 also has an L-shaped bracket 55 which is located above the upper surface of the plate 46'. An adjusting screw 57 passes through a slot 58 in the plate portion 47 and is threadably received in a threaded hole 56 in an upstanding portion 56' of the bracket 55. The screw 57 extends through a compression spring 59 which bears against the upstanding portion 56' of the bracket 56 and against the plate portion 47. The angular position of the ribbon guide 51 relative to the plate 46' and the print head 37 can be changed by rotating the screw 57. Rotation of the screw 57 causes the guide 51 to pivot about the stud 52. The compression spring 59 retains the guide 51 in its adjusted position. A mounting plate 60 which constitutes a heat sink for the print head 37 is secured to the underside of the plate 46' between the guides 49. The plate 54 is movably supported by and against the upper surface of the plate 60. Screws 61 secure the plates 46' and 60 to each other. Compression springs 62 are received in cup-shaped members 63 in the shelf 44 and bear against the upper surface of the plate 46'. A tab 64 having an aperture 65 is secured to the plate portion 46'. The tab 64 projects into a cross-shaped recess 66. The recess 66 has a first slot portion 67 which receives the tab 64 with clearance. The recess 66 also has a second slot portion 68 which bottoms out as shown in FIG. 2 for example. The slot portions 67 and 68 are perpendicular to each other. A round pin 66' passes through the hole 65 with clearance and rests in the slot portion 68. When the printer is in the operating position, the springs 62 are under greater compression than when the print head 37 is moved away from the platen roll 38. As seen in FIGS. 2 and 4, the shelf 44 has elongate grooves 69. In the position of FIG. 2, the knife edge 48 is spaced from parallel grooves 69. When the print head 37 and platen roll 38 are separated, the springs 62 will urge the print head assembly 45 to a position at which the knife edge 48 bears against one of the grooves 69 as shown in FIG. 3. Thus, the print head assembly 45 is held in approximately aligned position relative to the platen roll 38.

The mounting section 40 is shown to have a pair of annular portions 70 having aligned holes 71. Mounting section 39 (FIG. 5) also has a pair of annular portions 72 with opposed studs 73 received in the holes 71. The annular portions 72 also have studs 74 which are received in arcuate slots 75 in annular portions 70. The studs 74 cooperate with the ends of the slots 75 to limit the amount of rotation of the mounting section 40 relative to the mounting section 39.

Figure 5:
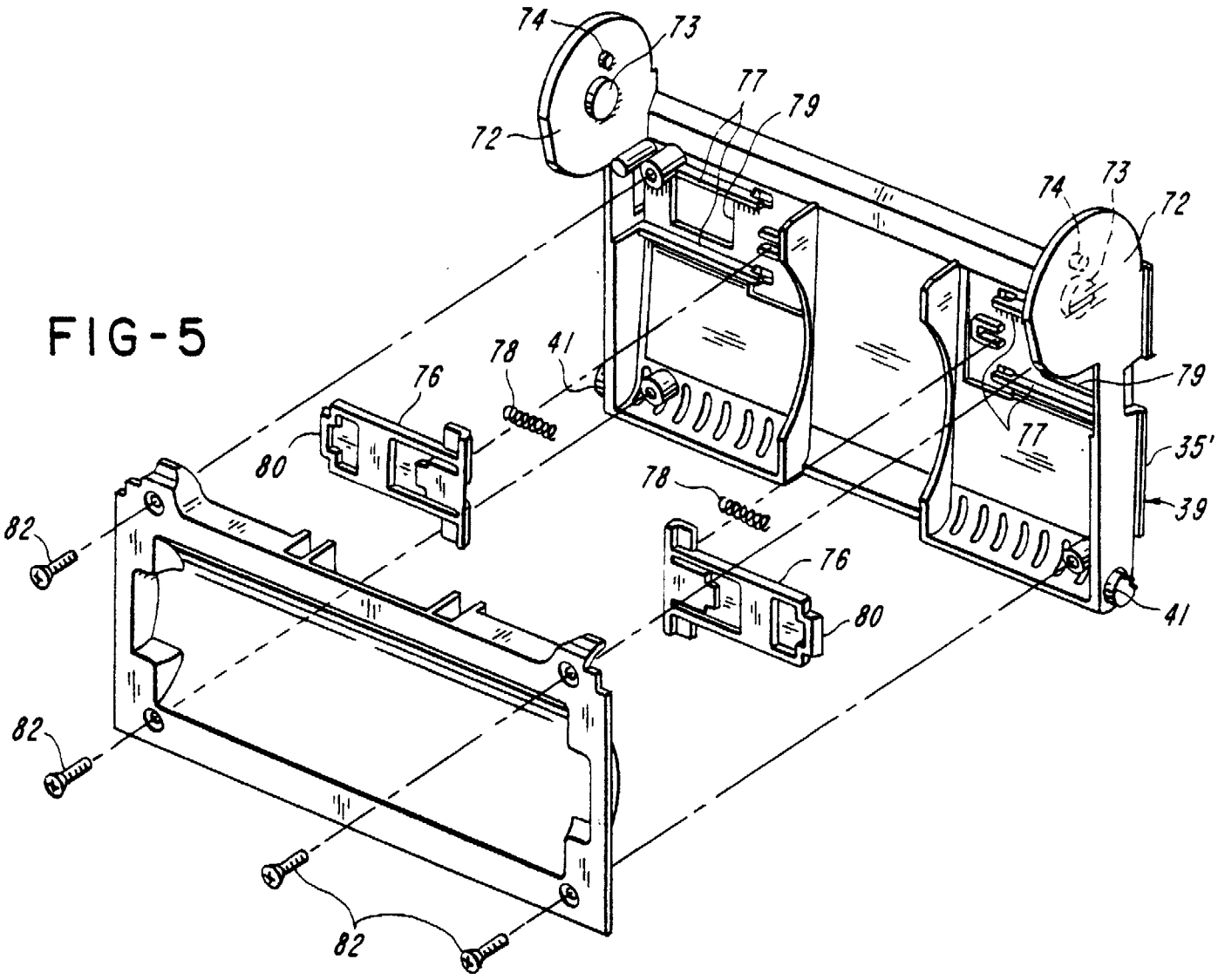
FIG. 5 is an exploded perspective view of a housing section which mounts the mounting section of FIG. 4.
Figure 6:
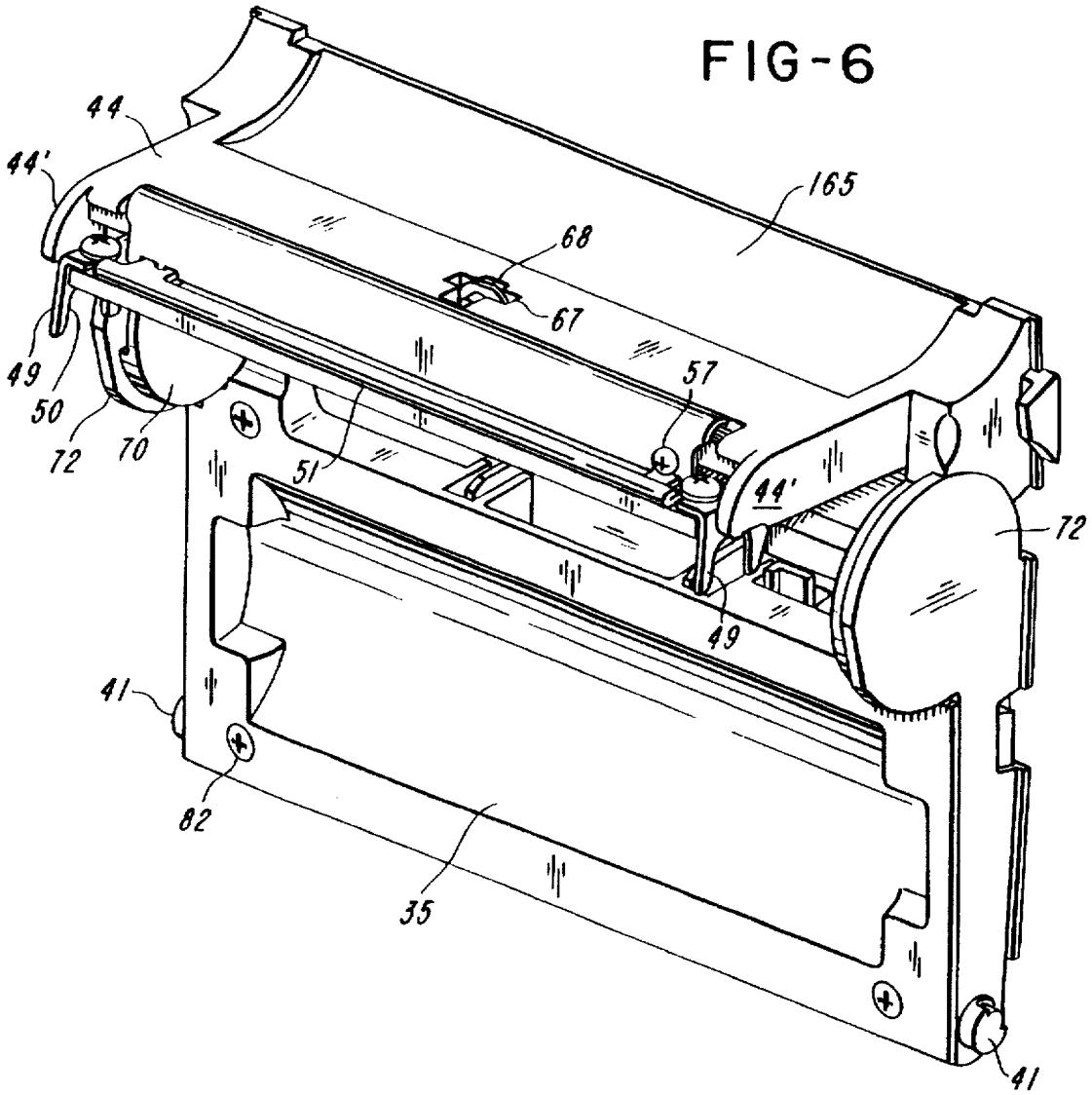
FIG. 6 is an assembled view of the mounting section and print head assembly shown in FIG. 4 and the mounting section shown in FIG. 5.

With reference to FIG. 5, the mounting section 39 is shown to include an outer wall 35'. The wall 35' mounts a pair of latches 76 guided in respective guides 77 and urged in opposite directions by compression springs 78. The latches 76 are manually movable and accessible through openings 79. The latches 76 have respective latch teeth 80 received in opposed pockets 81 (only one of which is shown in FIG. 2). The wall 35 is secured to the outer wall 35' by screws 82.

Figure 7:
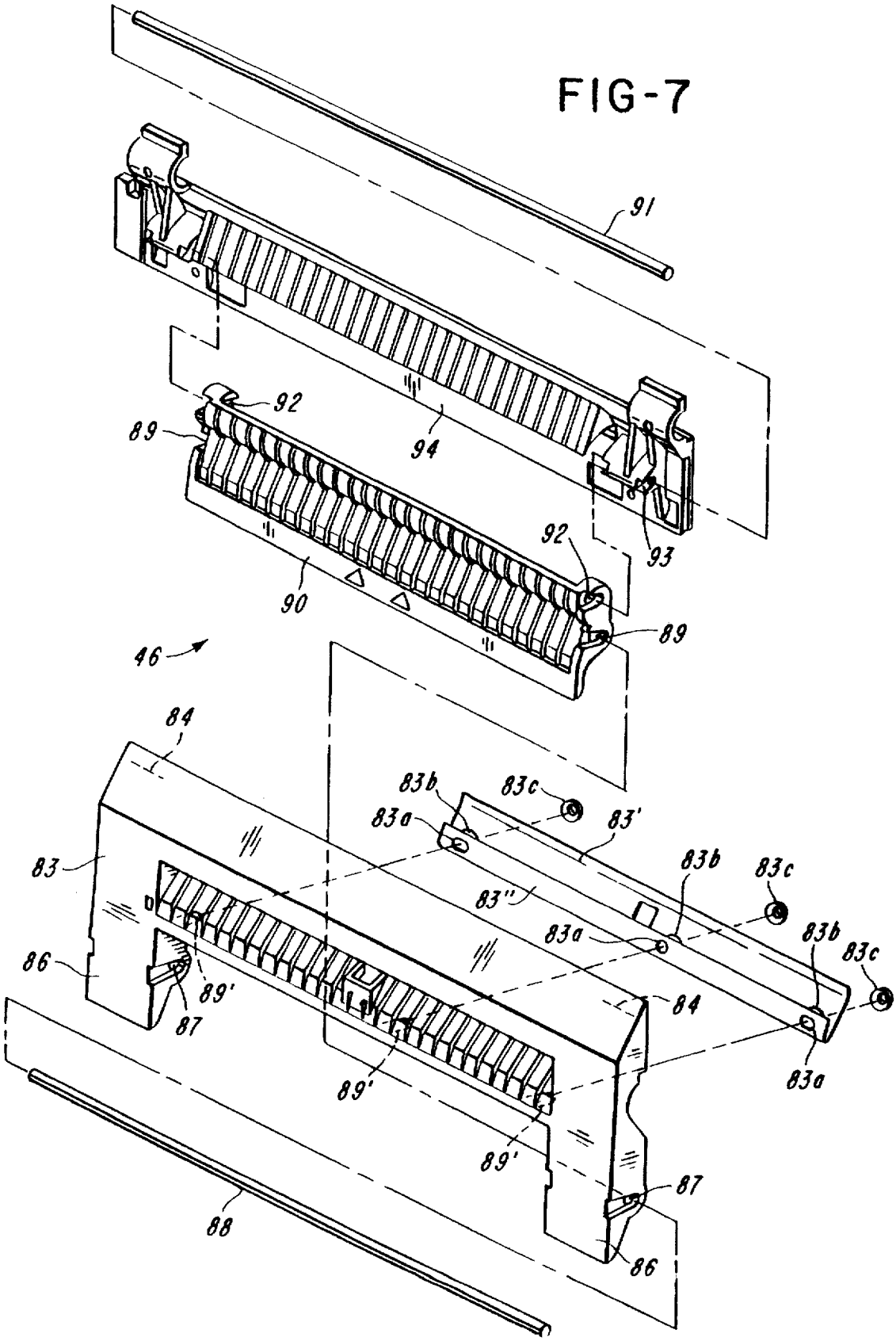
FIG. 7 is an exploded perspective view of an assembly for latching the ink ribbon cartridge and for guiding a carrier web of composite label web.
Figure 8:
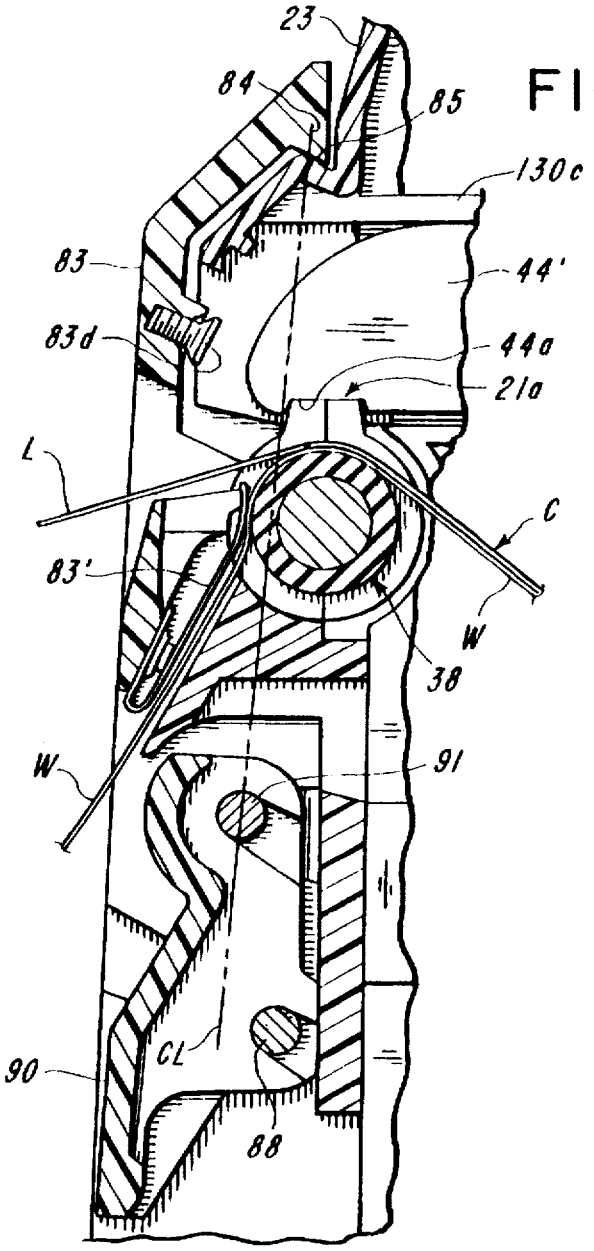
FIG. 8 is an enlarged sectional view of the assembly shown in FIG. 7 and associated components.

With reference to FIG. 7, the assembly 46 is shown in exploded form. Member 83 is shown to have a pair of latching grippers or gripper teeth. 84. As shown in FIGS. 2 and 8, the gripper 84 grips a surface 85 in the ink ribbon cartridge housing 23. The member 83 has a pair of spaced depending portions 86 which have aligned holes 87. A rod 88 passes through the holes 87 and through aligned holes 89 in a member 90. A rod 91 passes through holes 92 in the member 90 and through a hole 93 in a fixed member 94. When the assembly 46 is in the position shown in FIGS. 2 and 8, the members 83 and 90, which form a toggle linkage, are in an overcenter or latching condition. As shown for example in FIG. 8, the grip member 85 on the cartridge housing 23 is gripped by the latching gripper 84. The rod 88 overcenter with respect to a centerline CL to provide a toggle linkage or mechanism.

As seen in FIGS. 2 and 8, a leaf spring 83' secured to studs 89' on the member 83 is used to urge the carrier web W against the platen roll 38. The leaf spring 83' ensures that there is sufficient contact between the carrier web W and the platen roll 38. The leaf spring 83' has a connector portion 83" with holes **83*a*. Oversize holes 83*b* in the leaf spring 83' allow fasteners 83*c* to pass freely therethrough and to be press fitted onto the studs 89'**.

As seen in FIG. 8, a screw **83*d*** is adapted to hold an optional tear bar (not shown).

Figure 10:
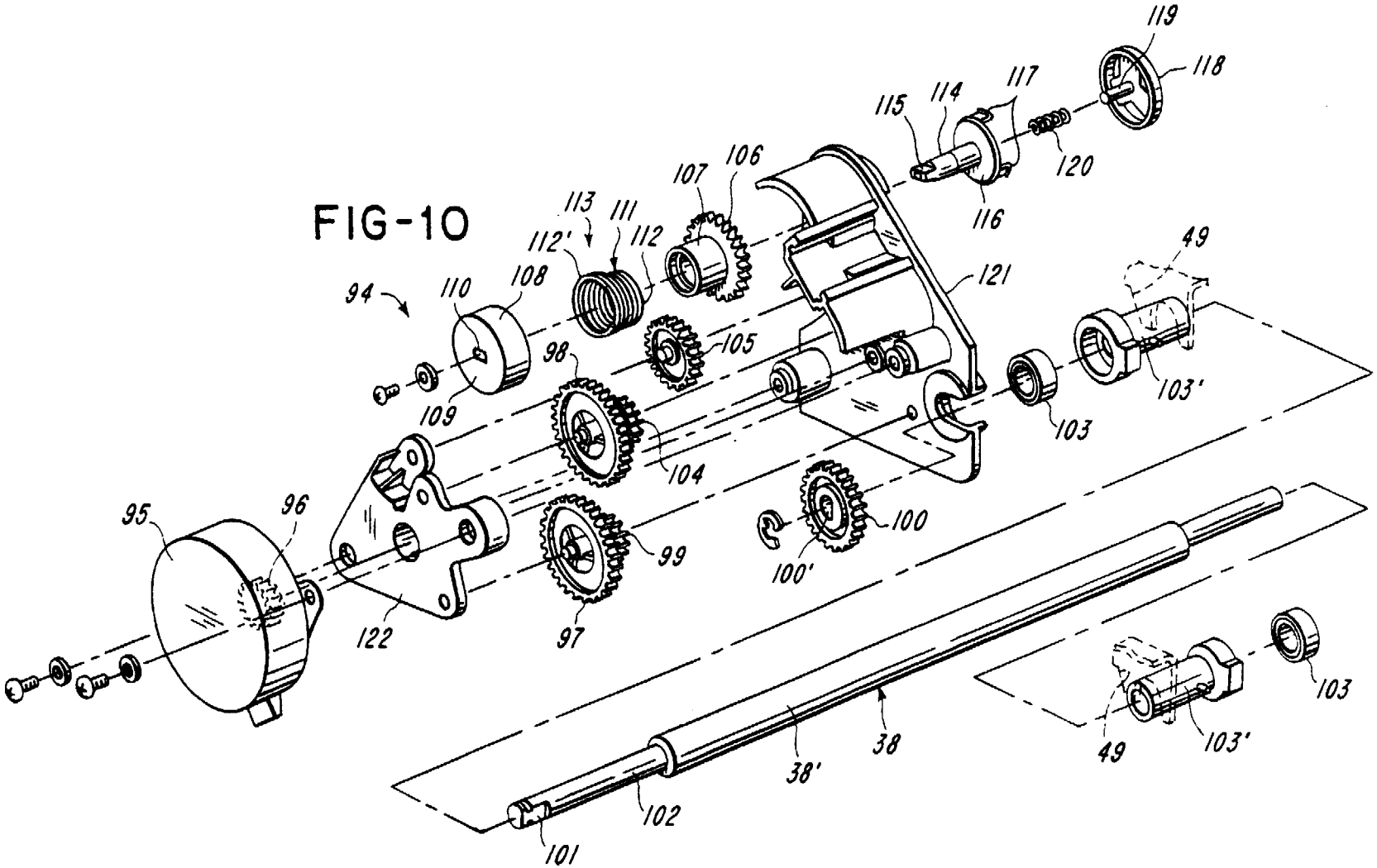
FIG. 10 is an exploded perspective view showing the drive mechanism for the printer and the ink ribbon cartridge.

With reference to FIG. 10, a drive mechanism is generally indicated at 94. The drive mechanism 94 includes an electric motor 95 for driving a gear 96. The gear 96 meshes with gears 97 and 98. Coaxially secured to the gear 97 is a gear 99 which meshes with a gear 100. The gear 100 has a non-circular hole 100' which receives a non-circular end portion 101 of a shaft 102. The platen 38 is comprised of a sleeve of resilient frictional material on the shaft 102. The shaft 102 is mounted in spaced bearings 103. The bearings 103 are mounted in bearing housings 103' mounted in the housing 21.

The gear 98 is secured to an axially aligned gear 104 which meshes with a gear 105. The gear 105 meshes with a gear 106. The gear 106 is secured to an axially aligned tubular clutch member 107. A tubular clutch member 108 has an end wall 109 with a non-circular hole 110. A wrapped clutch spring 111 has a first spring portion 112 received by the outside surface of the clutch member 107 and a second spring portion 112' received by the inside surface of the clutch member 108. A shaft 114 having a non-circular end portion 115 is received in the hole 110 so that the clutch member 108 and the shaft 114 rotate as a unit. The shaft 114 is secured to a disc 116 with three hook-shaped connectors 117 which couple to a drive member 118 for rewinding the ink ribbon IR in the ink ribbon cartridge 24. The drive member 118 includes a rod 119 telescopically received in the shaft 114. A spring 120 is also received in the shaft 114 and pushes on the rod 119. The connectors 117 couple to the drive member 118 and enable the drive member 118 to shift against the force of the spring 120 when the cartridge is being installed into the printer. When the motor 95 is operated, the platen roll 38 is driven and the drive member 118 is driven through the spring clutch 113 comprised of the clutch members 107 and 108 and the clutch spring 111. The clutch 113 assures that the proper tension is applied to the ink ribbon IR so that the ink ribbon is properly wound up in the cartridge.

The drive mechanism 94 is assembled using a frame member 121 secured to the housing 21. A bracket 122 and the frame member 121 rotatably mount motor 95, gears 97 and 99, 98 and 104, and 105, the shaft 114, and one of the bearing housings 103'.

Figure 11:
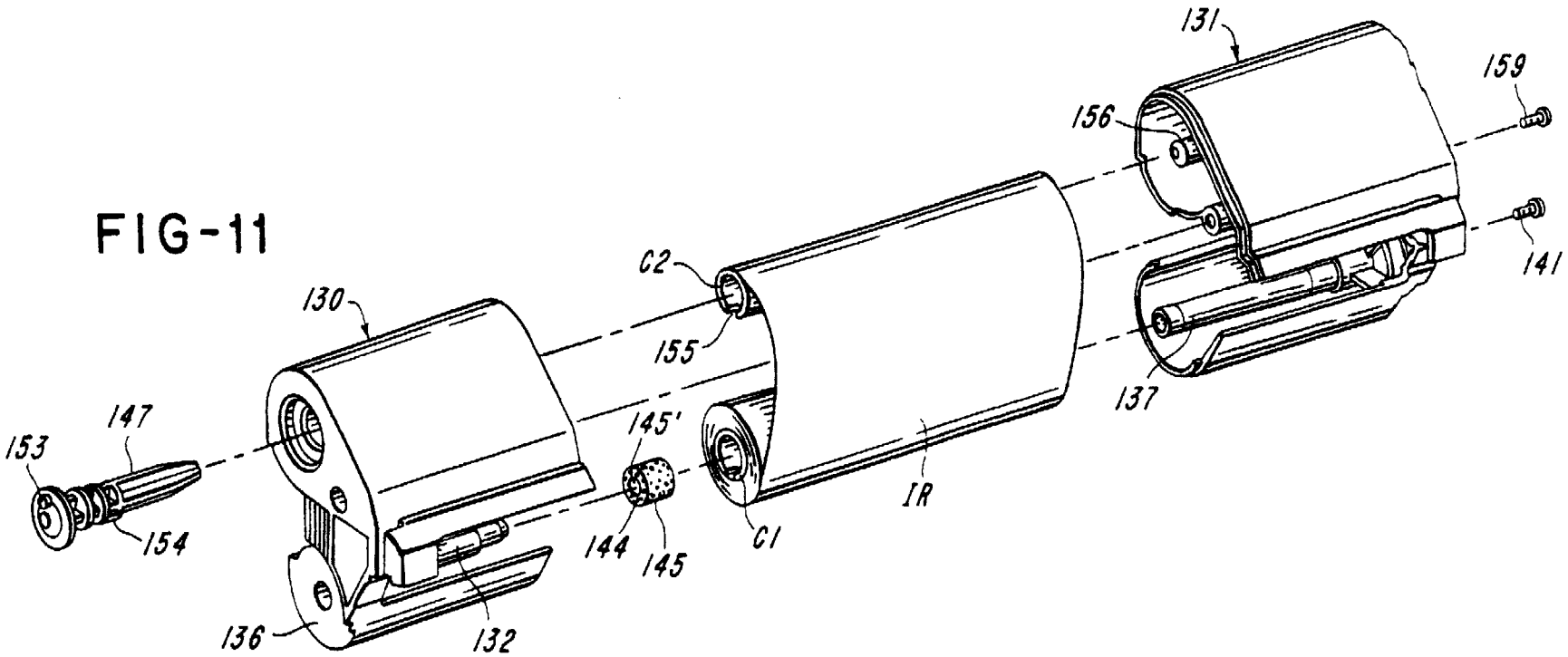
FIG. 11 is an exploded perspective view of the ink ribbon cartridge.
Figure 12:
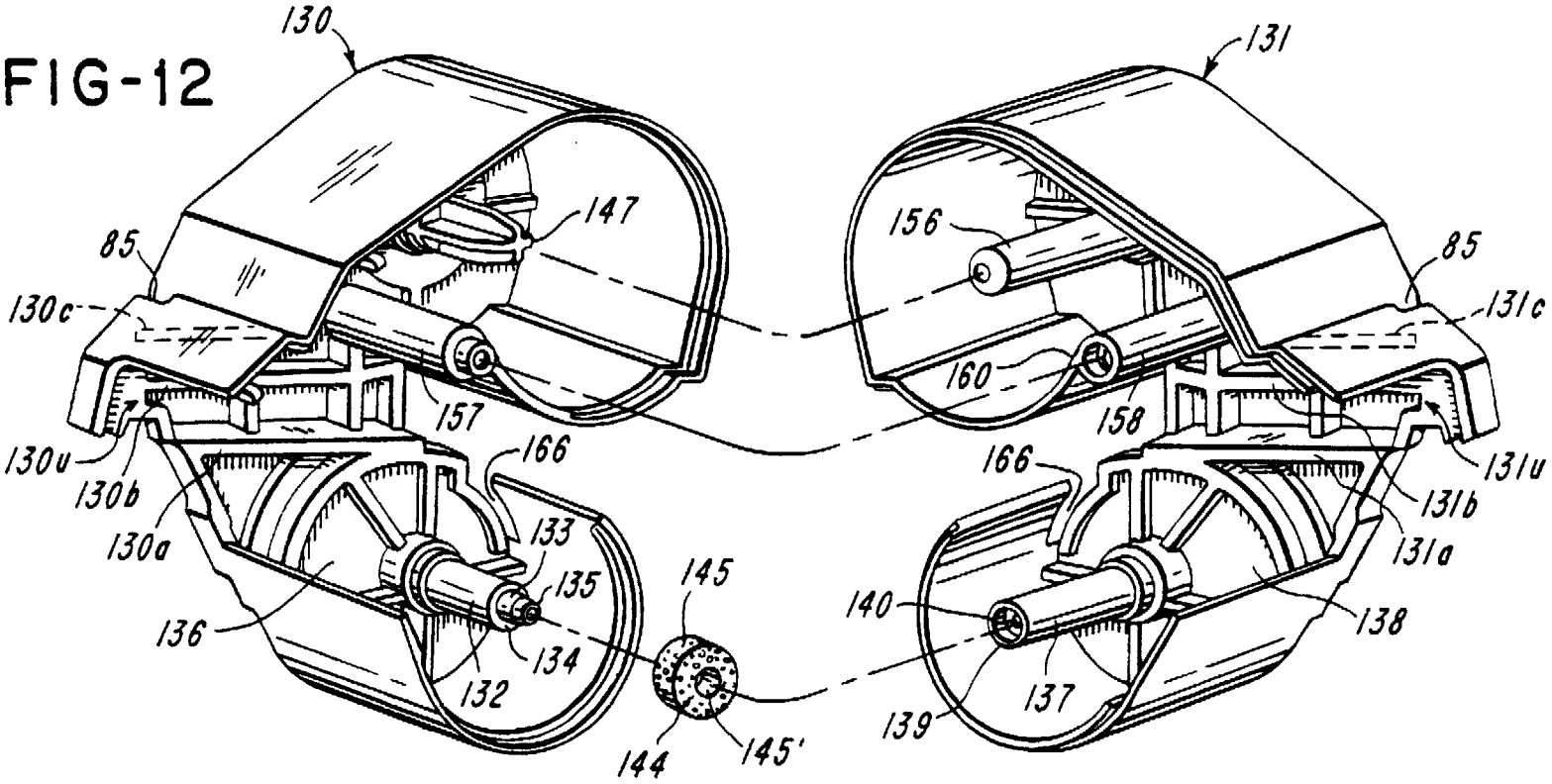
FIG. 12 is an exploded rotated perspective of cartridge housing sections shown in FIG. 11.

With reference to FIG. 11, there are shown housing sections generally indicated at 130 and 131, the ink ribbon IR, a tubular core or spool C1 on which the ink ribbon IR is wound into a roll R1 and a tubular core or spool C2 on which the used or spent ink ribbon is wound.

The cartridge housing 23 is comprised of the housing sections 130 and 131. The housing section 130 has an axially extending shaft member 132 with a planar end surface 134 and an axial reduced-diameter end portion or projection 133 extending from the planar surface 134. There is an axial hole 135 in the projection 133. The shaft member 132 extends outwardly from a wall 136 of the housing section 130. The housing section 131 has a shaft member 137 projecting from a wall or plate 138 of the housing section 131. The shaft member 137 terminates at a surface 139. A recess 140 in the shaft member 137 receives the projection 133. The housing sections 130 and 131 can be suitably connected either permanently as by a permanent adhesive or releasably. A screw 141 is shown to pass through a hole 142 within the shaft member 137 and to be threadably received in the axial hole 135 in the projection 133. As shown, the shaft members 132 and 137 are hollow.

A brake generally indicated at 143 is shown to comprise a tubular or sleeve member 144 having a frictional outer surface 145. The sleeve member 144 has a central hole 145' for receiving the projection 133. The sleeve member 144 is comprised of resilient closed-cell foam material and is positioned between surfaces 134 and 140. The distance between the surfaces 134 and 140 in their assembled position is less than the length of the sleeve member 144 in its unassembled, unrestrained condition so that the sleeve member 144 is slightly compressed in the axial direction in the position shown in FIG. 13. In that the sleeve member 144 is compressed, the sleeve member 144 is more dense than it is in its unrestrained condition prior to assembly. The shaft members 132 and 137 are stationary and the sleeve member 144 is held stationary on the projection 133. The outer surface 145 of the sleeve 144 is in frictional contact with the inner surface 146 of the core C1 . The core C1 can be composed of either plastic or cardboard. This causes a braking force or drag to be applied to the core C1 to maintain tension in the ink ribbon IR. The rotation of the platen roll 38 is sufficient, however, to cause the braking force exerted by the brake 143 to be overcome so that ink ribbon IR can be paid out or drawn from the ink ribbon supply roll.

The wall 136 also mounts a drive spindle 147 as best shown in FIG. 14. The spindle 146 is rotatably received in an internally-stepped annular portion 148. An internal flange 149 on the annular portion 148 is received between annular projections 150 and 151 on the spindle 147. The drive spindle 147 is, thus, held captive in the annular portion 148. A drive head 152 has a stud 153 which cooperates with any one of the grooves 118' in the drive member 118. As the drive member 118 rotates, the drive head 152 is driven via stud 153 to drive the core C2. The drive spindle 147 has a drive lug 154 which engages a notch 155 (FIG. 11) in the core C2.

The core C2 is supported both on the spindle 147 and on a shaft member 156. Posts 157 and 158 secured to respective walls 136 and 138 can be connected by a screw 159 passing through a hole 160 in the post 158 and threadably received in the post 157.

As best seen in FIG. 15, the housing sections 130 and 131 are positioned end-to-end. The upper housing member generally indicated at 161 is spaced upwardly from lower housing member 162 by an open space 163. As seen in FIG. 3, the cartridge 24 is inserted onto the printer 20 by moving the cartridge 24 relative to the shelf 44 and the print head assembly 45 until the cartridge 24 has been slid to the position shown in FIG. 2. The housing member 161 is tapered toward the center CE where the housing section 130 and 131 abut and the two abutting portions 130' and 131' which constitute the housing members 161 are flexible and resilient enough to deflect during assembly onto the printer 20 until arcuate portion 164 enters a recess 165 in the shelf 44. Thus, as the cartridge 24 is slid onto the printer 20 and the print head assembly 45 and the shelf 44 enter the open space 163, the arcuate surface 164 finally detents into the recess 165 to hold the cartridge 24 detented essentially in its operating position.

Figure 9:
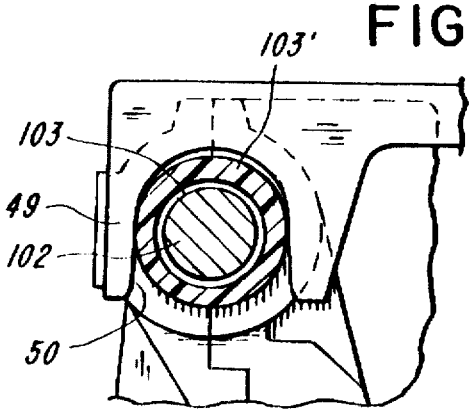
FIG. 9 is a fragmentary view showing the manner in which the print head is located relative to the platen.

It is to be noted that the cartridge housing 23 has slots 166 which permit the guides 49 to clear the cartridge housing 23. Upon such installation of the cartridge 24, the mounting section 39 can be pivoted on posts 41 counterclockwise as seen in FIG. 3, and thereupon the mounting section 40 can be pivoted counterclockwise about posts 73 until the guides 49 locate on the bearing housing 103', as seen in FIG. 9. This causes the print head 37 to be located precisely relative to the platen roll 38.

Thereupon the assembly 46 can be moved to the generally vertical position (FIG. 3) so that the latching gripper 84 can engage the grip member 85 on the cartridge housing 23. Thereupon the manually engageable member 90 can be pressed inwardly until the shaft 88 is in the overcenter position with respect to the centerline CL as shown in FIG. 8.

When the assembly 46 is latched, the arm portions 44' which have notches 44*a* are urged by webs 130*c* and 131*c* against the stop 21*a*, thus locating the cartridge 24 in its operating position.

Other embodiments and modifications of this invention will suggest themselves to those skilled in the art and all such of these as come within the spirit of this invention are included within its scope as best defined by the appended claims.

We claim:

1. A printer, comprising: a housing, a mounting assembly mounted in the housing for movement between an operating position and an open position, wherein the mounting assembly includes a first section pivotally mounted on the housing and a second section pivotally connected to the first section, a print head mounted on the second section, an ink ribbon cartridge mounted on the second section, the cartridge having means for defining an open space for receipt of the print head, and a platen mounted in the housing and cooperable with the print head in the operating position.

2. A printer, comprising: a printer housing, a print head and a cooperable platen, an ink ribbon cartridge having a cartridge housing for containing a supply of ink ribbon, and a toggle mechanism including a gripper tooth for engaging the cartridge housing for holding the cartridge to the printer housing.

3. A printer, comprising: a housing, a print head and a cooperable platen, an ink ribbon cartridge containing a supply of ink ribbon, a toggle mechanism for holding the cartridge to the housing, wherein the print head is capable of printing on a composite label web having a carrier web and labels releasably adhered to the carrier web, a resilient leaf spring for pressing the carrier web against the platen, and the leaf spring being mounted on the toggle mechanism.

4. A printer, comprising: a housing, a print head and a cooperable platen, an ink ribbon cartridge containing a supply of ink ribbon, a toggle mechanism for holding the cartridge to the housing, wherein the print head is capable of printing on a composite label web having a carrier web and labels releasably adhered to the carrier web, a resilient leaf spring for pressing the carrier web against the platen, the leaf spring being mounted on the toggle mechanism, wherein the toggle mechanism includes a first toggle member having means for gripping the cartridge, a second toggle member pivotally connected to the first toggle member, and a third toggle member connected to the second toggle member, and means providing a pathway for the carrier web between the second and third toggle members.

5. A printer, comprising: a housing, a mounting assembly mounted in the housing for movement between an operating position and an open position, wherein the mounting assembly includes a first section pivotally mounted on the housing and a second section pivotaly connected to the first section, means for releasably latching the first section to the housing, a print head mounted on the second section, an ink ribbon cartridge mounted on the second section, the cartridge having means for defining an open space for receipt of the print head, and a platen mounted in the housing and cooperable with the print head in the operating position.

6. A printer, comprising; a housing, a mounting assembly mounted in the housing for movement between an operating position and an open position, wherein the mounting assembly includes a first section pivotally mounted on the housing and a second section pivotally connected to the first section, means for limiting pivotal movement of the second section with respect to the first section, a print head mounted on the second section, an ink ribbon cartridge mounted on the second section, the cartridge having means for defining an open space for receipt of the print head, and a platen mounted in the housing and cooperable with the print head in the operating position.

7. A printer, comprising: a housing, a print head assembly including a print head and a plate for mounting the print head, a mounting section, means for biasing the mounting section and the print head assembly relatively away from each other, means for connecting the print head assembly to the mounting section to afford movement of the print head assembly in different planes, a platen roll cooperable with the print head, the platen roll having an axis of rotation, guides on the print head assembly, means adjacent the platen roll and cooperable with the guides for locating the print head in axial alignment with the axis of the platen roll, means for mounting an ink ribbon on the housing, and an ink ribbon guide on the print head assembly.

8. A printer comprising: a print head assembly including a print head, a plate for mounting the print head, a mounting section, means for biasing the mounting section and the print head assembly relatively away from each other, means for connecting the print head assembly to the mounting section to afford movement of the print head assembly in different planes, a platen roll cooperable with the print head, the platen roll having an axis of rotation, guides on the print head assembly, means adjacent the platen roll and guides for locating the print head in axial alignment with the axis of the platen roll, means for mounting an ink ribbon on the housing, an ink ribbon guide on the print head assembly, and means for adjusting the ink ribbon guide.

9. A printer, comprising: a print head assembly including a print head, a plate for mounting the print head, a mounting section, means for biasing the mounting section and the print head assembly relatively away from each other, means for connecting the print head assembly to the mounting section to afford movement of the print head assembly in different planes, a platen roll cooperable with the print head, the platen roll having an axis of rotation, guides on the print head assembly, means adjacent the platen roll and guides for locating the print head in axial alignment with the axis of the platen roll, means for mounting an ink ribbon on the housing, an ink ribbon guide on the print head assembly, means for pivoting the ink ribbon guide to a selected position, and means for securing the guide in the selected position.

10. A printer, comprising: a print head assembly including a print head, a plate for mounting the print head, a mounting section, means for biasing the mounting section and the print head assembly relatively away from each other, means for connecting the print head assembly to the mounting section to afford movement of the print head assembly in different planes, a platen roll cooperable with the print head, the platen roll having an axis of rotation, guides on the print head assembly, means adjacent the platen roll and guides for locating the print head in axial alignment with the axis of the platen roll, wherein the print head and the platen roll are movable relatively apart, grooves in the mounting section, an edge on the print head assembly for engaging in the grooves to hold the print head and the platen roll in approximately correct orientation while the print head and the platen roll are separated, and means for biasing the edge and the grooves into cooperation.

11. A printer, comprising: a housing, a print head and a cooperable platen, an ink ribbon cartridge containing a supply of ink ribbon, a toggle linkage for holding the cartridge to the housing, wherein the print head is capable of printing on a composite label web having a carrier web and labels releasably adhered to the carrier web, a resilient leaf spring for pressing the carrier web against the platen, and the leaf spring being mounted on the toggle linkage.

12. A printer, comprising: a printer housing, a print head and a cooperable platen, an ink ribbon cartridge having a cartridge housing for containing a supply of ink ribbon, a toggle mechanism engageable with the cartridge housing for holding the cartridge to the printer housing, and the toggle mechanism including a pair of separate pivotally connected toggle members.

13. A printer, comprising: a printer housing, a print head and a cooperable platen, an ink ribbon cartridge having a cartridge housing for containing a supply of ink ribbon, a toggle mechanism engageable with the cartridge housing for holding the cartridge to the printer housing, the printer being capable of printing on a composite web comprised of labels releasably adhered to a carrier web and an opening in the toggle mechanism for passage of the carrier web.

* * * * *

UNITED STATES PATENT AND TRADEMARK OFFICE

CERTIFICATE OF CORRECTION

PATENT NO. : 5,785,442

DATED : July 28, 1998

INVENTOR(S) : Paul H. Hamisch, Jr. and John D. Mistyurik

It is certified that error appears in the above-indentified patent and that said Letters Patent is hereby corrected as shown below:

Col. 1, line 8, "BACKFROUND" should be --BACKGROUND--.

Col. 4, line 39, after "gripper teeth" the period "." should be omitted.

Col. 7, line 53, "pivotaly" should be --pivotally--.

Signed and Sealed this

Twenty-ninth Day of December, 1998

*Attest:*

*Attesting Officer*

BRUCE LEHMAN

*Commissioner of Patents and Trademarks*